US005785112A

United States Patent [19]

Carrupt et al.

[11] Patent Number: 5,785,112

[45] Date of Patent: Jul. 28, 1998

[54] METHOD AND MODULAR CONTINUOUS CASTING MOLD FOR MANUFACTURING INGOTS

[75] Inventors: Bertrand Carrupt, Chamoson; Maurice Constantin, Sion, both of Switzerland

[73] Assignee: Alusuisse Technology & Management Ltd., Switzerland

[21] Appl. No.: 614,305

[22] Filed: Mar. 12, 1996

[30] Foreign Application Priority Data

Mar. 24, 1995 [CH] Switzerland ..... 00849/95

[51] Int. Cl.[6] ..... B22D 11/07; B22D 11/12; B22D 11/124; B22D 27/02

[52] U.S. Cl. ..... 164/472; 164/487; 164/268; 164/444; 164/468; 164/485; 164/443

[58] Field of Search ..... 164/487, 472, 164/137, 268, 341, 342, 444, 468, 504, 485, 486, 443

[56] References Cited

U.S. PATENT DOCUMENTS

| | | | |
|---|---|---|---|
| 4,699,200 | 10/1987 | Sedlacek | 164/268 |
| 4,709,744 | 12/1987 | Bryson et al. | 164/472 |
| 5,379,828 | 1/1995 | Blazek et al. | 164/268 |

FOREIGN PATENT DOCUMENTS

| | | |
|---|---|---|
| 477008 | 9/1976 | Australia . |
| 0060359 | 9/1982 | European Pat. Off. . |
| 0247768 | 5/1987 | European Pat. Off. . |
| 2454166 | 5/1975 | Germany . |
| 3315973 | 11/1984 | Germany . |
| 315653 | 10/1956 | Switzerland . |
| 2042385 | 9/1980 | United Kingdom . |
| 2042386 | 9/1980 | United Kingdom . |
| 9406584 | 3/1994 | WIPO . |

OTHER PUBLICATIONS

Continuous Casting, vol. 3, The Application of Electromagnetic Stirring (EMS) in the Continuous Casting of Steel, by J.P. Birat, pp. 21–34, 1984.

*Primary Examiner*—Joseph J. Hail, III
*Assistant Examiner*—I.-H. Lin
*Attorney, Agent, or Firm*—Bachman & LaPointe, P.C.

[57] ABSTRACT

Mold for continuously casting rolling slabs or extrusion billets where the mold is in the form of a hollow cylindrical body with a cylindrical mold interior, and an inlet and an outlet opening, and the mold comprises at least two closed, ring-shaped mold elements with a common concentric central axis, the mold axis, where a mold element, the inner sleeve, lies on the inside with respect to the mold axis and defines the sides of the cylindrical mold interior, and the other mold element, the supporting member, lies outside with respect to the central axis of the mold and accommodates the inner sleeve. The mold elements are releasably joined by inserting the inner sleeve in the supporting member, and side of the inner sleeve facing the supporting member and/or the side of the supporting member facing the inner sleeve are/is made such that, after joining the two elements of the mold together, a concentric, ring-shaped space, the second coolant chamber for accommodating coolant is formed between the inner sleeve and the supporting member.

29 Claims, 3 Drawing Sheets

METHOD AND MODULAR CONTINUOUS CASTING MOLD FOR MANUFACTURING INGOTS

BACKGROUND OF THE INVENTION

The invention relates to a mold for continuously casting rolling slabs or extrusion billets where the mold is in the form of a hollow cylindrical body with a cylindrical mold interior, and an inlet and an outlet opening, and the mold comprises at least two closed, ring-shaped mold elements with a common concentric central axis, the mold axis, where a mold element, the inner sleeve, lies on the inside with respect to the mold axis and defines sides of the cylindrical mold interior, and the other mold element, the supporting member lies on the outside with respect to the central axis (m) of the mold and accommodates the inner sleeve. The invention relates further to a process for manufacturing rolling slabs or extrusion billets from a metal or metal alloy by continuous casting using a mold according to the invention.

Known are molds that can be cooled and can be used for continuous casting molten metal into the form of slabs or billets that serve as starting material for further processing e.g. extrusion or rolling.

State of the art molds for continuous casting molten metals using a shape-giving molds that can be cooled comprise essentially of a coolable metal ring with inlet and outlet openings, and the metal ring normally enclosing a cylindrical or blunted cone shaped mold interior.

DE-OS 24 54 166 describes e.g. a mold for continuous vertical casting of copper alloys, where the mold is surrounded by coolant. For cleaning purposes or in order to replace the mold surface that shapes the material being cast, it is always necessary to change the whole mold.

Molds for manufacturing rolling slabs or extrusion billets containing homogeneously distributed primary solidified particles originating from degenerated dendrites are known from the patents DE 30 06 588 and DE 30 06 618.

During continuous casting, especially when casting thixotropic metal alloys, the inner walls of the mold in contact with the material being cast are subject to a high degree of wear. Continuous casting also subjects the mold to high thermal loads and pressure. Consequently, as a result of such thermal and mechanical effects during their service life, the molds may lose the optimum shape required to produce the desired of slab or billet profile. To achieve constant product quality, the metal billets or rolling slabs employed as starting material must always exhibit the same cross-sectional dimensions. Because of the high degree of dimensional accuracy demanded of billets used as starting material, the molds known to date have to be replaced at short production intervals. As the whole mold has to be removed from the continuous casting unit, a great deal of time, material and expense is involved.

SUMMARY OF THE INVENTION

The object of the present invention is therefore to provide a mold for continuous casting metals or metal alloys for the production of rolling slabs or extrusion billets, by means of which the above mentioned disadvantages are avoided and cost-favorable production of rolling slabs or extrusion billets with constant slab or billet cross-section is possible. A further object of the present invention is provision of a process for manufacturing rolling slabs or extrusion billets using such a cost saving mold.

The objective relating to the mold is achieved by way of the invention in that the mold elements are releasably joined by inserting the inner sleeve into the supporting member, and the side of the inner sleeve facing the supporting member and/or the side of the supporting member facing the inner sleeve are/is made such that, after joining the two elements of the mold together, a concentric, ring-shaped space, the second coolant chamber for accommodating coolant is formed between the inner sleeve and the supporting member.

The mold according to the invention exhibits two mold elements having different functions. The ring-shaped inner sleeve is for shaping the continuously cast material and represents therefore that part of the mold which is subject to a high degree of wear and dirt. The ring-shaped supporting member accommodates the inner sleeve in its essentially cylindrical interior and provides the mold with the mechanical stability required for continuous casting.

Usefully, both elements are essentially hollow cylindrical in shape. The cross-section of the mold may be e.g. any surface enclosed by a closed convex curve. The cross-sectional area is preferably enclosed by a circle or a convex polygon.

The composition of the mold according to the invention in two parts enables only one mold element to be replaced viz., that element which is subjected to a high degree of abrasion or dirt. Furthermore, the mold according to the invention allows the dirtied part of the mold to be removed for a simpler form of cleaning without having to dismantle the mold from the continuous casting unit, and enables therefore considerable savings to be made over state of the art mold.

In the mold according to the invention the parts which are complicated to produce by mechanical methods, e.g. means for accommodating and feeding coolant or lubricant, are usefully situated in the supporting member as these normally exhibit a much longer service life than the inner sleeve.

The mold according to the invention is suitable e.g. for horizontal or vertical continuous casting of molten metals, preferably light metals, in particular aluminum or aluminum alloys. In that respect all commercially available aluminum alloys and aluminum of all grades of purity are suitable.

The mold according to the invention is employed preferably for continuous casting metal alloys for manufacturing rolling slabs or extrusion billets containing homogeneously distributed primary solidified particles originating from degenerated dendrites. Such rolling slabs or extrusion billets employed as starting material exhibit thixotropic properties on being heated to a temperature which lies between the corresponding solidus and liquidus temperature of the metal alloy. In the thixotropic condition the metal alloys of such rolling slabs or extrusion billets contain regressed solid dendritic primary particles in a surrounding matrix of liquid metal. In order to achieve e.g. good casting, rolling and finished part properties, rolling slabs or extrusion billets which are to be processed further in the thixotropic state preferably exhibit a homogeneously distributed fine, isotropic grain structure, the degenerated dendrites preferably exhibiting a globulitic structure.

The supporting member of the mold according to the invention may be of any material which provides the mold with sufficient mechanical strength also at elevated temperatures and adequate stability of shape. Usefully, metals or metal alloys and in particular aluminum or its alloys are employed. Highly preferred is for the supporting member to be made out of AlMgSi alloys.

The inner sleeve is preferably made of aluminum or its alloys or copper or its alloys. Highly preferred is for the inner sleeve to be made out of AlMgSi alloys. In a further preferred form of the mold according to the invention the inner sleeve is of aluminum or an aluminum alloy and features a graphite layer or graphite ring on the surface facing the mold interior.

BRIEF DESCRIPTION OF THE DRAWINGS

The present invention is described in greater detail by way of example with the aid of FIGS. 1 to 3, wherein.

DETAILED DESCRIPTION OF PREFERRED EMBODIMENTS

Figure 1:
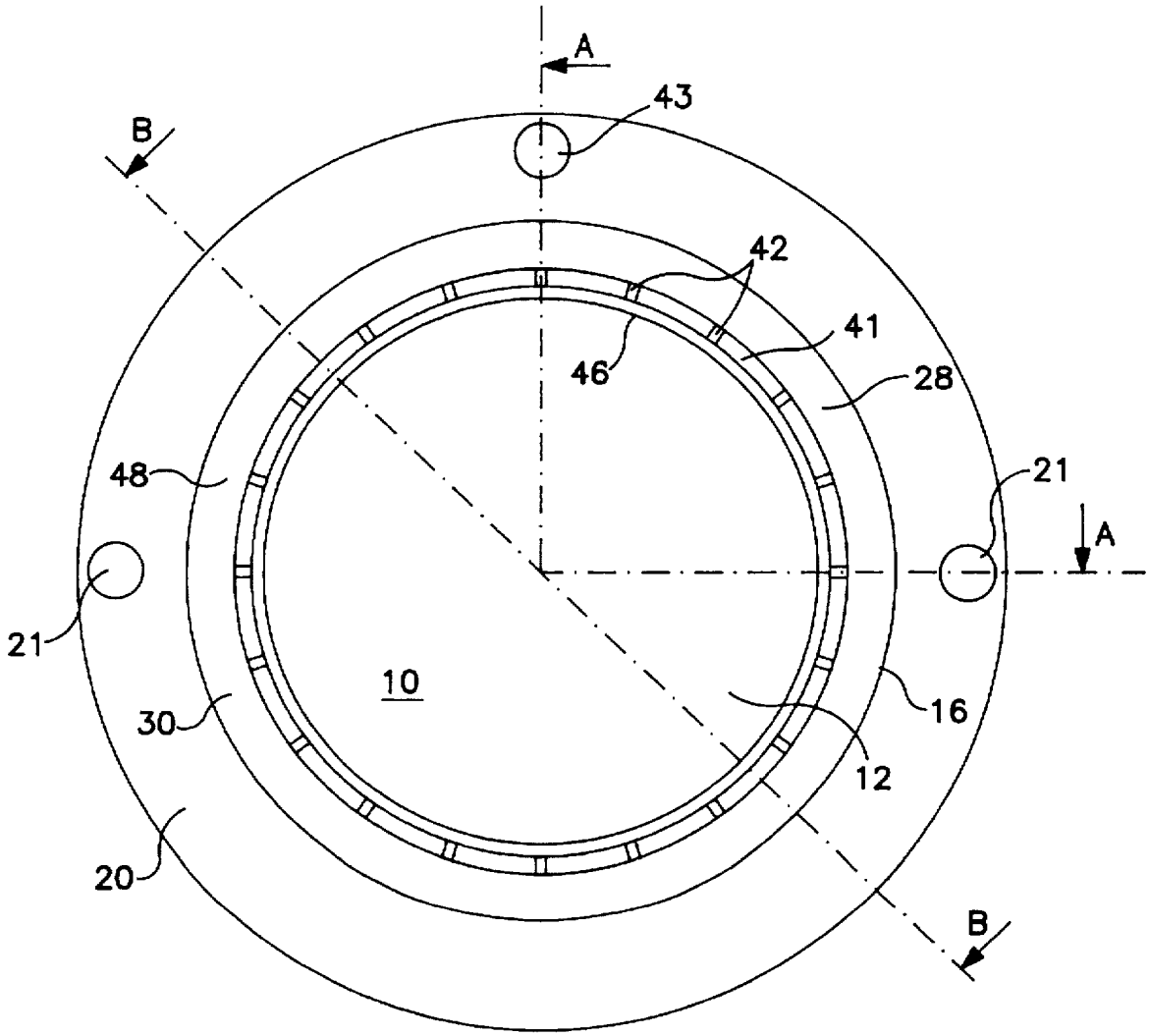
FIG. 1 shows a plan-view of the inlet end of the mold according to the invention.

The dimensions of the mold according to the invention depend e.g. on the desired final dimensions of the rolling slab or extrusion billet. The length of the interior of the mold or length of the inner sleeve is e.g. 2 to 20 cm, usefully 2 to 10 cm and preferably 3 to 6 cm. The length of the supporting member is e.g. 3 to 25 cm, usefully 3 to 15 cm, preferably 4 to 8 cm. The diameter of the mold interior is e.g. 3 to 20 cm, usefully 4 to 15 cm and preferably 6 to 15 cm. The outer diameter of the supporting member is in general not critical; it is e.g. 8 to 25 cm, usefully 9 to 20 cm, preferably 11 to 18 cm.

The elements of the mold are releasably joined to each other. The joining of the two mold elements is effected by inserting the inner sleeve into the supporting member, the inner sleeve preferably being pushed completely into the supporting member. The join of the releasably attached mold elements is preferably tight against fluid media.

The side of the inner sleeve facing the supporting member and/or the side of the supporting member facing the sleeve are/is made such that after joining the two elements of the mold together, a concentric, ring-shaped space, the so-called secondary coolant chamber for accommodating coolant is formed between the inner sleeve and the supporting member. This second coolant chamber enables the inner sleeve to be cooled, as a result of which the surface of the inner sleeve facing the mold interior, the so-called inner face of the inner sleeve, acts as a cooling surface for the continuously cast material flowing past it during the casting process. In order to ensure the best possible flow of heat between the continuously cast material to be cooled and the coolant in the second coolant chamber, the wall of the essentially hollow cylindrical inner sleeve is usefully thin.

To accommodate coolant, the supporting member preferably contains a ring-shaped space, the so-called first coolant chamber which is concentric with the mold axis and means for feeding the coolant from an external source into the first coolant chamber, the first and second coolant chambers being connected by one or more connecting channels or by a ring-shaped opening which is concentric with the mold axis. The connecting channels may e.g. be in the form of holes in the supporting member. The ring-shaped connecting opening is preferably formed by a ring-shaped recess in the supporting member and is concentric with the mold axis; the ring-shaped recess forms at least in part the ring-shaped connecting opening and is made such that it can accommodate a ring-shaped body, the so-called coolant distributor, which features through holes. The ring-shaped body is e.g. in the form of a metal ring with through holes in it. The ring-shaped recess is preferably such that surface of the coolant distributor ring in the ring-shaped recess facing the interior of the mold is flush with the inner face of the supporting member. In a particularly advantageous version two neighboring through holes in the coolant distributor ring,—as viewed in a cross-section of the coolant distributor ring,—enclose the same sector angle with respect to the mold axis. Very highly preferred is when two through holes enclose sector angles of 6° to 12° with respect to the mold axis. The details of degrees of angle in the text always refer to a full circle of 360°.

The supporting member preferably exhibits at least one, preferably 1 to 4, coolant channels by means of which the first coolant chamber is connected to the inlet end face of the supporting member for connecting up with the external coolant supply source. By inlet end face is meant the side of the supporting member facing the inlet opening.

In an especially preferred version of the mold according to the invention the supporting member preferably exhibits on the side facing the mold interior a cylindrical inner face on which an integral ring-shaped rib is provided at the exit end facing the mold interior. Especially preferred is the inner sleeve in the form of a hollow cylindrical shaped part with an integral ring-shaped flange at the inlet end, where the ring-shaped flange faces the supporting member and the hollow cylindrical shaped part of the inner sleeve comes to rest on the rib of the supporting member and the ring-shaped flange comes to rest on the cylindrical shaped inner face of the supporting member, with the result that the ring-shaped space formed by the inner sleeve and the supporting member form the second coolant chamber.

The height of the flange and the height of the rib is preferably chosen such that the inner surface of the inner sleeve is a straight cylindrical surface, the central axis of which coincides with that of the mold.

In a further preferred form the mold according to the invention, the second coolant chamber exhibits means for dispersing coolant uniformly over the surface of the rolling slab or extrusion billet as it emerges from the mold. The means for uniformly dispersing the coolant over the surface of the rolling slab or extrusion billet comprises preferably of a plurality of, preferably 40 to 70, secondary coolant channels which on the one hand connect up to the second coolant chamber and on the other hand are directed in an inclined manner at the surface of the rolling slab or extrusion billet emerging from the mold.

Especially preferred are secondary coolant channels which are arranged radially such that—viewed in a cross-section through the molds,—two neighboring secondary coolant channels enclose the same sector angle with respect to the mold axis, the sector angle preferably amounting to 5° to 10°, based on a full circle of 360°.

In a further preferred version of the mold according to the invention the mold elements exhibit means for feeding lubricant to the inlet end face of the inner sleeve. Especially preferred is for the inner sleeve on the side facing the supporting member and/or the supporting member on the side facing the inner sleeve to exhibit a ring-shaped recess which is concentric with the mold axis such that, when both elements of the mold are fitted together, a ring-shaped space, the lubricant distributor ring, for accommodating lubricant is formed. Particularly preferred is when the ring-shaped recess is sealed at the inlet and outlet ends with ring-shaped sealing means which are situated between the inner sleeve and the supporting member. Very highly preferred is for the supporting member to feature on the side facing the inner sleeve and/or the inner sleeve to feature ring-shaped recesses on the side facing the supporting member at the inlet and outlet ends with respect to the distributor ring, said recesses being arranged such that, when both elements of the mold are fitted together ring-shaped spaces are formed into which the sealing material e.g. sealing rings may be introduced.

The lubricant distributor ring is connected to the inlet end face of the inner sleeve preferably via a plurality of lubricant channels, preferably 15 to 30, recessed into the inner sleeve, and the lubricant distributor ring is connected to at least one, preferably 1 to 4, lubricant feeding channels recessed into the supporting member for supplying lubricant from an external lubricant supply source, the connection between the lubricant feeding channel and the external supply source preferably being at the inlet end face of the supporting member. Very highly preferred is,—as viewed in a cross-section through the inner sleeves,—for two neighboring lubricant channels to enclose, with respect to the mold axis, the same sector angle of preferably 10° to 30°,—referring to a full circle of 360°.

Also preferred is for the inlet end face of the inner sleeve to exhibit a ring-shaped recess, the so-called lubricant exit ring, which connects the lubricant channels joining up with the inlet end face of the inner sleeve. This lubricant exit ring has the function of improving the radial distribution of the lubricant further.

In a further preferred version of the mold according to the invention, in order to ensure favorable distribution of lubricant onto the inner face of the inner sleeve accommodating the continuously cast material, the inner sleeve exhibits lubricant feeding means on its inner face. These means of feeding lubricant may e.g. be in the form of grooves running essentially parallel to the axis of the mold. Usefully, the grooves are designed such that they widen conically in their breadth and depth towards the outlet opening. In order that a significant amount of lubricant does not flow out of the lubricant feeding means without lubricating the rest of the inner face of the inner sleeve, the lubricant feeding means do not begin immediately at the inlet opening, i.e. in a preferred version of the mold according to the invention the lubricant feeding means begin,—as viewed in the direction of flow of the continuously cast material,—only after a certain distance amounting e.g. to ¼ to ⅓ of the length of the mold interior. The number of grooves required depends e.g. on the material being cast, the lubricant, the continuous casting parameters and the size of the mold interior and is usefully 100 to 300, preferably 150 to 200 grooves.

With respect to the process, the object of the invention is achieved in that a molten metal or metal alloy i.e. a molten material for continuous casting is fed through the shape-giving mold comprising at least two closed ring-shaped mold elements having a common central axis, the mold axis, where one mold element, the supporting member lies on the outside with respect to the mold axis and one mold element, the inner sleeve, lies on the inside, the mold elements are releasably joined and the mold elements feature means for supplying coolant to cool the inner face of the inner sleeve facing the mold interior and for jetting for jetting coolant onto the rolling slab or extrusion billet after it emerges from the mold interior, and the mold elements feature further means for supplying lubricant to the inlet end face of the inner sleeve, the whole of the inner face of the inner sleeve is continuously lubricated, the continuously cast material is subjected to a primary cooling at the inner face of the inner sleeve with the result that the rolling slab or extrusion billet emerging from the mold is in the solid state, at least in its outer edge region, and the rolling slab or extrusion billet is cooled by secondary cooling by coolant striking it after it emerges from the mold.

The process according to the invention is especially suitable for horizontal or vertical continuous casting of aluminum or its alloys, including aluminum of all purities and all commercially available aluminum alloys.

The process according to the invention is employed preferably for manufacturing rolling slabs or extrusion billets having uniformly distributed primary solidified solid particles originating from individual degenerated e.g. globulitic dendrites, the continuously cast material being stirred vigorously at least in the whole of the solidification zone.

Suitable for the production of rolling slabs or extrusion billets with homogeously distributed primary solidified particles from individual degenerated dendrites are e.g. aluminum alloys, magnesium alloys or zinc alloys and in particular alloys of the AlSi, AlSiMg, AlSiCu, AlMg, AlCuTi and AlCuZnMg types.

The molten continuous casting material is e.g. introduced into the mold according to the invention by means of an inlet nozzle which, at least in part, comprises a ceramic sleeve. Essential for the production of rolling slabs or extrusion billets containing homogeneously distributed primary solidified particles from individual degenerated dendrites is the vigorous stirring, of the continuous casting material, e.g. already in a part of this ceramic sleeve as well as in the whole of the solidification zone i.e. in the whole of the mold interior and in the region of the rolling slab or extrusion billet where a part of the alloy is still in the molten state.

The stirring of the melt takes place preferably by means of an electromagnetic stirring device that generates a magnetic field rotating about the mold axis. Especially preferred is stirring with a stator of a multi-pole e.g. two, four or, in particular, six poled induction motor.

FIG. 1 shows a plan view of the inlet end of the mold according to the invention for vertical or horizontal continuous casting of rolling slabs or extrusion billets. The plan view shows the inlet end face of the releasably joined mold elements, the supporting member 20 and the inner sleeve 30, where both mold elements 20, 30 exhibit a common central axis, the so-called mold axis m, and exhibit a rotational symmetric cross-section with respect to that axis m. The plan view also shows the circular inlet opening 12 to the mold interior 10. The inner sleeve 30 lies in the releasably attached state of the mold elements 20, 30,—at least partially,—directly on the inner face 16 of the supporting member 20, the inlet end face 48 of the inner sleeve 30 being set back with respect to the inlet end face of the supporting member 20 with the result that a space, the nozzle recess 28, is created and into which a sleeve,—e.g. made of ceramic materials,—of an inlet nozzle for the casting material to be fed through the mold can be introduced and fitted by virtue of its shape. The sleeve of the inlet nozzle is thereby fitted tightly to the inlet end face 48 of the inner sleeve in such a manner that during continuous casting no continuously cast material can escape between the inner face 16 of the supporting member 20 and the sleeve of the inlet nozzle.

The supporting member 20 shown in FIG. I exhibits two coolant channels 21 for introducing coolant into the first coolant chamber 22, both coolant channels 21 in cross-section enclosing a sector angle of 180° with respect to the mold axis m. The coolant channels 21 join the first coolant channel 22 to the inlet end face of the supporting member 20. As viewed in cross-section, the coolant channels 21 exhibit a circular opening and run inside the supporting member parallel to the axis m of the mold. FIG. 1 shows further the opening of a lubricant feeding channel 43 in the supporting member 20 which—as viewed in cross-section, —encloses a sector angle of 90° (a right angle) with respect to the mold axis m and the coolant channels 21. The lubricant feed channel 43 exhibits a circular opening as viewed in cross-section and runs parallel to the mold axis m inside the supporting member 20.

The plan view of a mold according to the invention shown in FIG. 1 also shows the inlet openings of a plurality of lubricant channels 42 and a lubricant exit ring 41. The inlet openings of the lubricant channels 42 are uniformly distributed over the end face of the supporting member i.e. two neighboring lubricant channels 42,—as viewed in cross-section,—always enclose the same sector angle with respect to the mold axis m. The lubricant exit ring 41 is in the form of a ring-shaped recess in the inlet end face 48 of the inner sleeve 30, it collects the lubricant emerging from the lubricant channels 42 and distributes it uniformly over the whole of the lubricant exit ring 41. During the whole of the casting process, the lubricant makes contact with the casting material flowing through the mold interior 10 as a result of which a uniform thin film of lubricant is formed between the continuously cast material and the inner face 46 of the inner sleeve 30.

Figure 2:
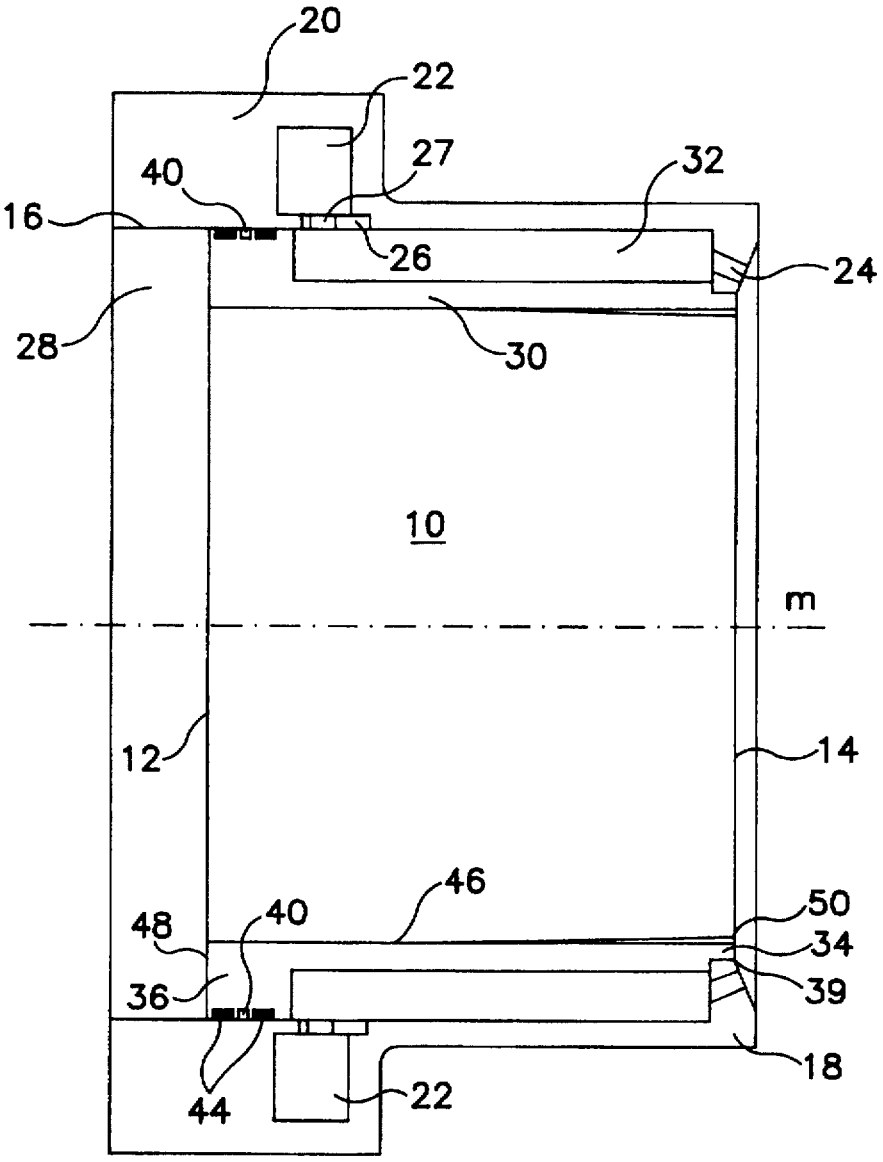
FIG. 2 shows a longitudinal cross-section of the mold running through the mold axis along line B in FIG. 1.

FIG. 2 shows a longitudinal section of the mold through the mold axis m along line B—B in FIG. 1 and reveals the inner sleeve 30 which is releasably attached to the supporting member 20. The space enclosed by the inner face 46 of the inner sleeve 30 and the inlet and outlet openings 12, 14 forms the cylindrical mold interior 10. The supporting member 20 lies on the outside with respect to the mold axis m and the inner sleeve 30 on the inside.

The supporting member 20 contains a ring-shaped first coolant chamber 22 which is concentric with the mold axis m and is connected by means of at least one coolant channel 21 to the inlet end face of the supporting member 20 for the purpose of introducing coolant into the first coolant chamber 22

The inner sleeve 30 is designed on the side facing the supporting member 20 such that, on fitting the two mold elements 20, 30 together, a ring-shaped second coolant chamber 32 which is concentric with the mold axis m and is connected to the first coolant chamber 22 via a coolant distributor ring 26, is formed between the inner sleeve 30 and the supporting member 20.

The coolant distributor ring 26 is a separate mold element in the form of a metal ring with a plurality of through holes 27 whereby, as viewed in cross-section, two neighboring through holes 27 enclose the same sector angle with respect to the mold axis m. The supporting member 20 exhibits on its side facing the mold interior, a ring-shaped recess which is concentric with the mold axis m and at least in part features a ring-shaped opening connecting it to the first coolant chamber 22. The ring-shaped recess serves the purpose of accommodating the coolant distributor ring 26 with through holes 27. The ring-shaped recess and the coolant distributor ring 26 are designed such that the coolant distributor ring 26 fits by virtue of shape into the ring-shaped recess in the supporting member 20, i.e. such that the inner face of the coolant distributor ring 26 is flush with the inner face 16 of the supporting member 20. The coolant distributor ring 26—made of a metal ring with through holes 27 in it—may e.g. be divided at one place so that the it may be deformed elastically in order to be inserted into the ring-shaped recess.

The inner sleeve 30 features on the side facing the supporting member 20 a ring-shaped recess which is concentric with the mold axis m and, together with the side of the supporting member 20 facing the mold interior, forms a ring-shaped space, the lubricant distributor ring 40, to accommodate lubricant. The lubricant distributor ring 40 is connected to a lubricant feed channel 43 recessed into the supporting member 20. The lubricant distributor ring 40 has the function therefore of radially distributing the lubricant flowing through the feed channels. Further, the lubricant distributor ring 40 is connected,—via a plurality of lubricant channels in the inner sleeve 30—to the inlet end face 48 of the inner sleeve in order that the lubricant in the lubricant distributor ring 40 can flow through the radially, e.g. uniformly distributed lubricant channels 42 into the lubricant exit ring 41 in the inlet end face 48 of the sleeve 30. The lubricant channels 42 are preferably arranged such that,—viewed in cross-section of the mold,—two neighboring lubricant channels 42 enclose the same sector angle with respect to the mold axis m. The lubricant is again distributed uniformly radially in the lubricant exit ring 41. During continuous casting, the lubricant in the lubricant exit ring 41 makes contact with the continuously cast material with the result that a thin film of lubricant is formed between the cast material and the inner face 46 of the inner sleeve 30.

The lubricant distributor ring 40 formed by the ring-shaped recess in the inner sleeve 30 and the inner face 16 of the supporting member 20 is sealed on the inlet and outlet ends by ring-shaped sealing means 44 that are positioned between the inner sleeve 30 and the supporting ring 20, i.e. on both sides of the ring-shaped recess in the inner sleeve 30 necessary to form the lubricant distributor ring 40, the inner sleeve may exhibit further ring-shaped recesses that run parallel to the lubricant distributor ring 40, perpendicular to the mold axis, and—for example together with corresponding recesses in the supporting member 20,—serve to accommodate ring-shaped sealing means 44 such as sealing rings.

The inner sleeve 30 also exhibits on its inner face 46 grooves 50 that run parallel to the mold axis m and widen conically with respect to their depth and breadth in the direction of the exit opening 14. These grooves 50 serve essentially to conduct the lubricant in the exit side region of the mold interior 10 i.e. they serve the purpose of distributing the lubricant radially in a uniform manner. In order that the lubricant does not flow away to a large extent through the grooves 50 without forming a uniform film of lubricant over the inner face 46, the grooves 50 which are recessed into the inner sleeve do not begin until a certain distance in the direction of flow of the cast material e.g. ¼ to ⅓ along the length of the mold interior 10 or the inner sleeve 30.

On the side facing the mold interior, the supporting member 20 exhibits a cylindrical inner face 16 on which a ring-shaped rib 18 is formed at the exit end pointing towards the mold interior. The inner sleeve 30 exhibits a hollow cylindrical part 34 with a ring-shaped flange 36 formed on it at the inlet end, said flange 36 pointing towards the supporting member 20. The ring-shaped flange 36 contains the lubricant channels 42 and the ring-shaped recesses required to make the lubricant distributor ring 40, the lubricant exit ring 41 and to accommodate the sealing means 44. The hollow cylindrical part 34 of the inner sleeve 30 exhibits in the exit end region,—on the side facing the supporting member,—a further ring-shaped recess, the stop 39. This has the function of accommodating the outer region of the ring-shaped rib 18 of the supporting member 20 pointing towards the mold interior 10.

Joining the two mold elements 20, 30 is usefully made by inserting the inner sleeve 30 into the supporting member 20 such that the ring-shaped stop 39 lying in the exit end region of the inner sleeve 30 comes to rest and engages by virtue of fit in the outer region of the ring-shaped rib 18 of the supporting member 20 that points in the direction of the mold interior 10. On pushing the mold elements 20, 30 one inside the other, the hollow cylindrical part 34 of the inner sleeve 30 comes to rest on the ring-shaped rib 18 and the projection 38 of the ring-shaped flange 36 comes to rest on the cylindrical inner face 16 of the supporting member 20 so that the ring-shaped space enclosed by the inner sleeve 30 and the supporting member 20 form the second cooling chamber 32. The height of the flange 36 and the height of the ring-shaped rib 18 are chosen such that the inner face 46 of the inner sleeve 30 forms a straight cylindrical face, the central axis of which coincides with the axis m of the mold.

The hollow cylindrical part 34 of the inner sleeve 30 serves to provide primary cooling of the casting material flowing through the mold interior 10 and therefore,—in order to obtain good conductivity of heat from the material being cast to the coolant,—is preferably thin walled. Preferably, at least the hollow cylindrical part 34 of the inner sleeve 30 is made of a material with good thermal conductivity, preferably copper, copper alloys, aluminum or aluminum alloys. Also preferred are hollow cylindrical parts 34 of aluminum or aluminum alloys which feature a graphite ring on the side facing the mold interior.

The ring-shaped rib 18 of the supporting member 20 exhibits a plurality of secondary coolant channels 24, e.g. 40 to 60, that are directed in a sloping manner from the mold at the emerging slab and are connected to the second coolant chamber 32 and provide secondary cooling by jetting coolant onto the rolling slab or extrusion billet after it leaves the exit opening 14.

Figure 3:
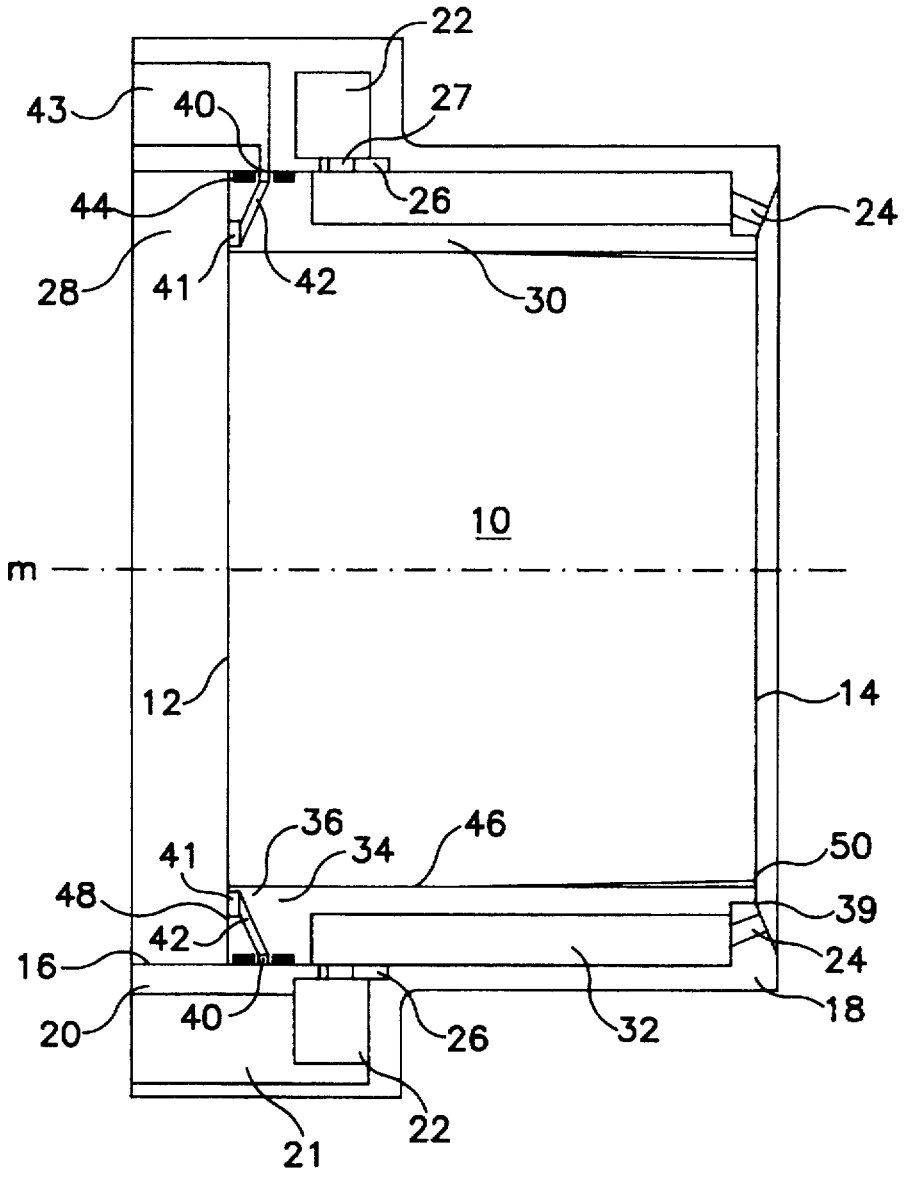
FIG. 3 shows a longitudinal cross-section of the mold along line A—A in FIG. 1 and shows therefor a cross-section of the mold that runs through a lubricant supply channel and through a coolant channel.

FIG. 3 shows a longitudinal cross-section through the mold along the line A—A in FIG. 1 and shows therefore a longitudinal section that runs through a lubricant feed channel 43 and through a coolant channel 21. In this longitudinal section, apart from the features already shown in FIG. 2, are a coolant channel 21 for introducing coolant into the first coolant chamber 22 and the lubricant feed channel 43 for introducing lubricant into the lubricant distributor ring 40.

The mold according to the invention may be employed for the manufacture of conventional rolling slabs or extrusion billets by continuous casting molten metal alloys or for manufacturing rolling slabs or extrusion billets containing homogeneously distributed primary solidified particles that originate from individual degenerated dendrites. The mold according to the invention permits fast replacement of the inner sleeve i.e. replacement of only that part of the mold subjected to abrasion and dirt,—as a result of which the production costs for rolling slabs and extrusion billets may be reduced significantly in comparison with rolling slabs and extrusion billets produced using known, state of the art mold.

We claim:

1. Mold for continuously casting ingots, suitable for slabs or extrusion billets, which comprises: a mold in the form of a hollow cylindrical body having a mold axis, a cylindrical shaped mold interior, and an inlet and an outlet opening; said mold including at least two closed, ring-shaped mold elements with a common concentric central axis which is the mold axis; wherein one mold element is an inner sleeve with respect to the mold axis, has sides thereof, and defines the cylindrical shaped mold interior; and the other mold element is a supporting member with sides thereof and lies outside with respect to the mold axis and the inner sleeve and accommodates the inner sleeve; wherein the mold elements are releasably joined by the inner sleeve inserted into the supporting member; and at least one side of the inner sleeve facing the supporting member and a side of the supporting member facing the inner sleeve are made such that, after joining the two ring-shaped mold elements together, a concentric, ring-shaped space which is a second coolant chamber for accommodating coolant, is formed between the inner sleeve and the supporting member.

2. Mold according to claim 1, wherein the supporting member contains a ring-shaped chamber which is a first coolant chamber, which with respect to the mold axis lies concentric to it and serves the purpose of accommodating coolant, and including means for feeding coolant from an external coolant supply source to the first coolant chamber, wherein the first and the second coolant chambers are connected.

3. Mold according to claim 2, wherein the first and the second coolant chambers are connected via at least one connecting channel.

4. Mold according to claim 2, wherein the first and the second coolant chambers are connected via a ring-shaped connecting opening which is concentric with the mold axis.

5. Mold according to claim 4, wherein the ring-shaped connecting opening is formed by a ring-shaped recess in the supporting member, where the ring-shaped recess at least in part forms the ring-shaped connecting opening and is made such that it can accommodate a ring-shaped body comprising a coolant distributor ring provided with through holes.

6. Mold according to claim 2, wherein the supporting member includes an inlet end and at least one coolant channel by means of which the first coolant chamber is connected to the inlet end of the supporting member for connection to the external coolant supply source.

7. Mold according to claim 6, wherein the supporting member includes 1–4 coolant channels.

8. Mold according to claim 1, wherein the second coolant chamber includes means for uniformly jetting coolant onto the surfaces of the ingots emerging from the mold interior.

9. Mold according to claim 8, wherein the means for uniformly jetting coolant onto the surface of the ingots comprises a plurality of secondary coolant channels which on the one hand are connected to the second coolant channel and on the other hand are directed in a sloping manner at the surface of the ingots emerging from the mold.

10. Mold according to claim 9, including 40–70 of said secondary coolant channels.

11. Mold according to claim 9, wherein the secondary coolant channels are arranged uniformly in a radial manner so that, viewing the mold in cross-section, two neighboring secondary coolant channels with respect to the mold axis enclose the same sector angle.

12. Mold according to claim 11, wherein the same sector angle based on a full circle of 360° is between 5° and 10°.

13. Mold according to claim 1, wherein the inner sleeve has an inlet end and the mold elements include means for delivering lubricant to the inlet end of the inner sleeve.

14. Mold according to claim 13, wherein at least one of (1) the inner sleeve on the side facing the supporting member and (2) the supporting member on the side facing the inner sleeve, exhibit a ring shaped recess that is concentric with respect to the mold axis, such that when both elements of the mold are fitted together there is formed a ring-shaped space comprising a lubricant distributor ring, to accommodate lubricant.

15. Mold according to claim 14, wherein the lubricant distributor ring has inlet and outlet ends and is sealed on the inlet and outlet ends by ring-shaped sealing means that rest between the inner sleeve and the supporting member.

16. Mold according to claim 14, wherein the lubricant distributor ring is connected to the inlet end of the inner sleeve by means of a plurality of lubricant channels in the inner sleeve, and the lubricant distributor ring is connected to at least one lubricant feeding channel in the supporting member for supplying lubricant from an external lubricant supply source.

17. Mold according to claim 16, wherein the supporting member has an inlet end and including 1–4 lubricant feeding channels, and wherein the connection of the lubricant feeding channels to the external lubricant supply source is at the inlet end of the supporting member.

18. Mold according to claim 16, wherein, as viewed in a cross-section through the inner sleeve, two neighboring lubricant channels enclose the same sector angle, with respect to the mold axis.

19. Mold according to claim 18, wherein the same sector angle is 10°–30°, referring to a full circle of 360°.

20. Mold according to claim 16, wherein referring to a full circle of 360° the inlet end of the inner sleeve exhibits a ring-shaped recess comprising a lubricant exit ring, which joins together the lubricant channels merging into the inlet end of the inner sleeve.

21. Mold according to claim 1, wherein the inner sleeve has an inner face and features on its inner face lubricant feeding means which run parallel to the mold axis.

22. Mold according to claim 21, wherein the lubricant feeding means are in the form of grooves running parallel to the mold axis that do not begin until ¼ to ⅓ along the length of the mold interior.

23. Mold according to claim 22, wherein said grooves widen conically with respect to their depth and breadth towards the mold outlet opening.

24. Process for manufacturing ingots, suitable for rolling slabs or extrusion billets, which comprises: providing a continuously casting a mold in the form of a hollow cylindrical body having a mold axis and a cylindrical mold interior, and an inlet and an outlet opening, wherein said mold with at least two closed, ring-shaped mold elements with a common concentric central axis which is the mold axis, moreover, one of said mold elements as an inner sleeve with respect to the mold axis and lies inside with respect to the mold axis and defines the cylindrical mold interior and has an inner face facing the mold interior and has an inlet end, furthermore the other of said mold elements is a supporting member and lies outside with respect to the mold axis and the inner sleeve and accommodates the inner sleeve; feeding a molten metal or metal alloy for continuous casting through the cylindrical mold interior to give shape to the molten metal to produce a continuously cast ingot; including in the ring-shaped mold elements means for supplying coolant to cool the inner face of the inner sleeve and for jetting coolant onto the ingot emerging from the mold interior; including in the mold elements means for supplying lubricant to the inlet end of the inner sleeve; continuously lubricating the whole of the inner face of the inner sleeve; subjecting the continuously cast material to primary cooling at the inner face of the inner sleeve with the result that the ingot emerging from the mold is in the solid state, at least in its outer edge region, and cooling the ingot by coolant striking said ingot after it emerges from the mold.

25. Process according to claim 24, for manufacturing ingots wherein said continuously cast ingot has a solidifying zone, and including the step of vigorously stirring said ingot at least in the solidifying zone to obtain homogeneously distributed, primary solidified particles originating from degenerated dendrites.

26. Process according to claim 25, wherein the stirring of the continuously cast ingot is performed using an electromagnetic stirring device which produces a magnetic field rotating around the mold axis.

27. Process according to claim 26, wherein the stirring is performed by means of a stator of a multi-poled induction motor.

28. Process according to claim 27, wherein said multi-poled induction motor is from two to six poled.

29. Process according to claim 24, wherein the mold elements are releasably joined by the inner sleeve inserted into the supporting member, and at least one of the side of the inner sleeve facing the supporting member and the side of the supporting member facing the inner sleeve is made such that, after joining the two ring-shaped mold elements together, a concentric, ring-shaped space, the second coolant chamber for accommodating coolant, is formed between the inner sleeve and the supporting member.

* * * * *